US006819634B2

(12) United States Patent
Igarashi

(10) Patent No.: US 6,819,634 B2
(45) Date of Patent: Nov. 16, 2004

(54) ELECTRONIC CLOCK

(75) Inventor: Kiyotaka Igarashi, Nishitokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 31 days.

(21) Appl. No.: 10/111,731

(22) PCT Filed: Aug. 30, 2001

(86) PCT No.: PCT/JP01/07467

§ 371 (c)(1),
(2), (4) Date: Apr. 26, 2002

(87) PCT Pub. No.: WO02/19041

PCT Pub. Date: Mar. 7, 2002

(65) Prior Publication Data

US 2002/0172100 A1 Nov. 21, 2002

(30) Foreign Application Priority Data

Aug. 31, 2000 (JP) ..... 2000-262214

(51) Int. Cl.[7] ..... G04B 1/00; G04C 3/00
(52) U.S. Cl. ..... 368/204; 368/64; 368/203
(58) Field of Search ..... 368/66, 203–205, 368/64

(56) References Cited

U.S. PATENT DOCUMENTS 5,008,865 A * 4/1991 Shaffer et al. ..... 368/10
6,320,822 B1 * 11/2001 Okeya et al. ..... 368/66
6,327,225 B1 * 12/2001 Okeya et al. ..... 368/157
6,343,051 B1 * 1/2002 Yabe et al. ..... 368/64
6,396,772 B1 * 5/2002 Yabe et al. ..... 368/204
6,424,600 B1 * 7/2002 Okeya et al. ..... 368/204

FOREIGN PATENT DOCUMENTS

| | | |
|---|---|---|
| JP | S54-46070 | 4/1979 |
| JP | S57-211579 | 12/1982 |
| JP | H5-60075 | 9/1993 |
| JP | H10-319143 | 12/1998 |
| JP | H11-84028 | 3/1999 |

* cited by examiner

*Primary Examiner*—Randy W. Gibson
*Assistant Examiner*—Michael L. Lindinger
(74) *Attorney, Agent, or Firm*—Koda & Androlia

(57) ABSTRACT

When an external switch means (1) is operated, a setting means (4) receives an output signal G1 therefrom and outputs setting signals S for varying the internal resistance of an adjusting means (5). When the internal resistance of the adjusting means (5) is varied, the potential (voltage value) at point A of the input value to a sensing means (6) is varied because it is the product of the generation quantity (current) of a power generating means (11) and the internal resistance. When the potential at point A exceeds a threshold value (H), the sensing means (6) outputs a sensing signal K of L level. When the sensing signal K of L level is outputted, the operation of the electronic timepiece changes to a power save mode where the drive of the second hand is stopped, for example. Thus the operation of the electronic timepiece changes to a power save mode when the power generation level of the power generating means (11) is equal to or lower than a specified level. Illumination by external light in the power save mode can be made constant even if the transmittance of the dial is different by adjusting the resistance of the adjusting means (5).

15 Claims, 8 Drawing Sheets

ELECTRONIC CLOCK

TECHNICAL FIELD

The present invention relates to an electronic timepiece, and more particularly to an electronic timepiece having a powersave mode.

BACKGROUND ART

Electronic timepieces that switch to a powersave mode in which power consumption is reduced, for example, by stopping the drive of the second hand requiring high power consumption when a predetermined condition is satisfied are widely used. In particular, a widely known technique is an electronic timepiece having power generating means, such as solar cells, and a power generation sensing function in which power save operates when power is not generated. An appropriate document in which this technique is disclosed is Japanese Patent Publication No. Hei 5-60075, filed by the present applicant.

In this Japanese Patent Publication is disclosed a timepiece having what is called a powersave function where the light striking the timepiece is sensed by an illuminance sensing circuit (power generation sensing circuit), where the hands are stopped to reduce power consumption and only the time is counted by the circuit when it is dark, and the current time is restored when it is bright.

However, the solar timepiece is constrained in terms of timepiece design since the solar cells for receiving light and generating power have a dark appearance. Recent solar timepieces use a light transmitting dial with a white ceramic plate and the solar cells are positioned underneath (inside the timepiece) the dial. Thus, timepieces with superior designs have been commercialized and with solar cells that are difficult to see from the outside. However, the light transmittance differs depending on the type of dial, such as the ceramic plate thickness, material, and color, and when the same timepiece module is used, the brightness of the ambient light at which the power save is entered differs depending on the product type since the sensing level of the illuminance sensing circuit is fixed. In other words, when the illuminance sensing level is set to match a dial having a high light transmittance, and a product uses a dial having a low light transmittance, the generated energy of the solar cells underneath the dial having a low light transmittance is smaller compared to when a dial having a high light transmittance is used so that the power save is entered even though the ambient light is sufficiently bright.

Furthermore, in the case where the power consumption for driving the second hand differs depending on the timepiece and the generated energy at which the power save is entered is fixed, when the generated energy that is slightly larger than the generated energy at which the power save is entered is supplied for long period, the energy stored in the storage means, such as a secondary cell, gradually decreases depending on the type of timepiece, resulting in the possibility that the timepiece may stop.

DISCLOSURE OF INVENTION

It is an object of the present invention to solve the above-mentioned problems and provide an electronic timepiece in which a predetermined value can be adjusted in the power-save mode switching means for switching to the power-save mode when the level of the energy generated by the power generating means is less than or equal to the predetermined value.

In order to achieve the above-mentioned object, the present invention, in an electronic timepiece having power save means for switching to a power-save mode that reduces power consumption when a predetermined condition is satisfied, comprises power generating means, storage means for storing energy generated by the power generating means, power save-mode switching means for switching to the power-save mode when the level of energy generated by the power generating means is less than or equal to a predetermined value, and adjusting means for setting the predetermined value for each different timepiece or type of timepiece having differences in a ability to generate energy under an ambient power generating condition.

Furthermore, it is preferable for the predetermined value to be greater than or equal to a predetermined generated energy capable of driving the timepiece.

Furthermore, it is preferable for the predetermined value to be greater than or equal to a predetermined generated energy capable of driving the second hand.

Furthermore, it is preferable for the adjusting means to comprise resistors and switches for selecting the resistors.

Furthermore, it is preferable to provide setting means for controlling the adjusting means and to have a setting mode to allow operation of the setting means.

Furthermore, it is preferable for the state of the switches selecting the resistors of the adjusting means to select a maximum resistance until the setting mode is first allowed.

Furthermore, it is preferable for the setting means to be user setting means for controlling the adjusting means by user input.

Furthermore, in a state where light of predetermined illuminance is supplied to the timepiece, it is preferable for the setting mode to control the adjusting means, and it is more preferable for the predetermined illuminance to be 10 lux or lower and even more preferable for the predetermined illuminance to be 5 lux or lower.

Furthermore, it is preferable for the setting mode to complete operation by a change in output of the power-save mode switching means.

Furthermore, it is preferable to have informing means for operating at completion of operation of the setting mode.

Furthermore, it is preferable to enable the setting mode to be entered by an external switch operation.

Furthermore, it is preferable to enable the setting mode to be entered by a contract-free external magnetic field control.

Furthermore, it is preferable to enable the setting mode to be entered through one mode of userselectable added functions.

MODE(S) FOR CARRYING OUT THE INVENTION

Figure 1:
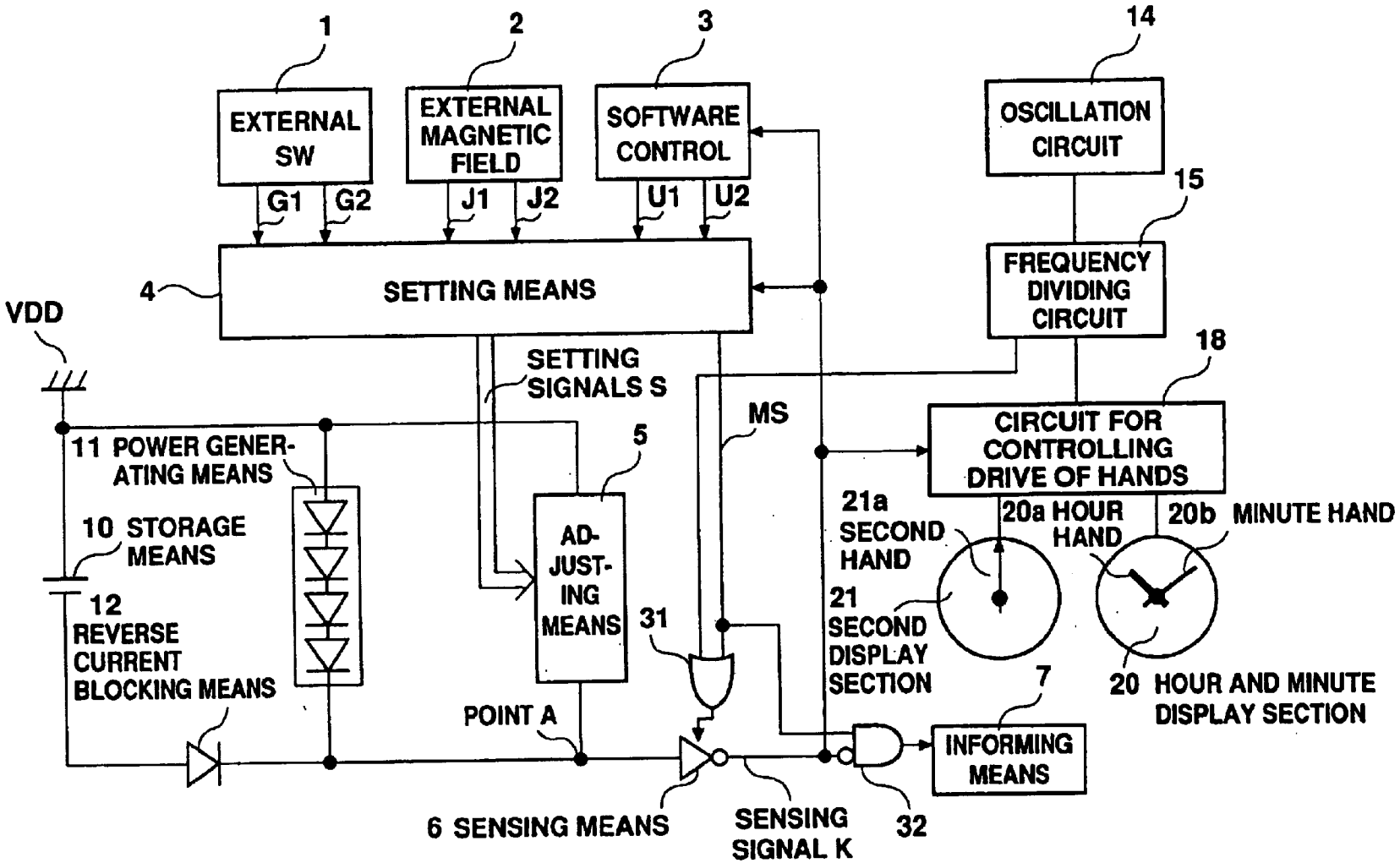
FIG. 1 is a circuit block diagram of an embodiment of the present invention.
Figure 2:
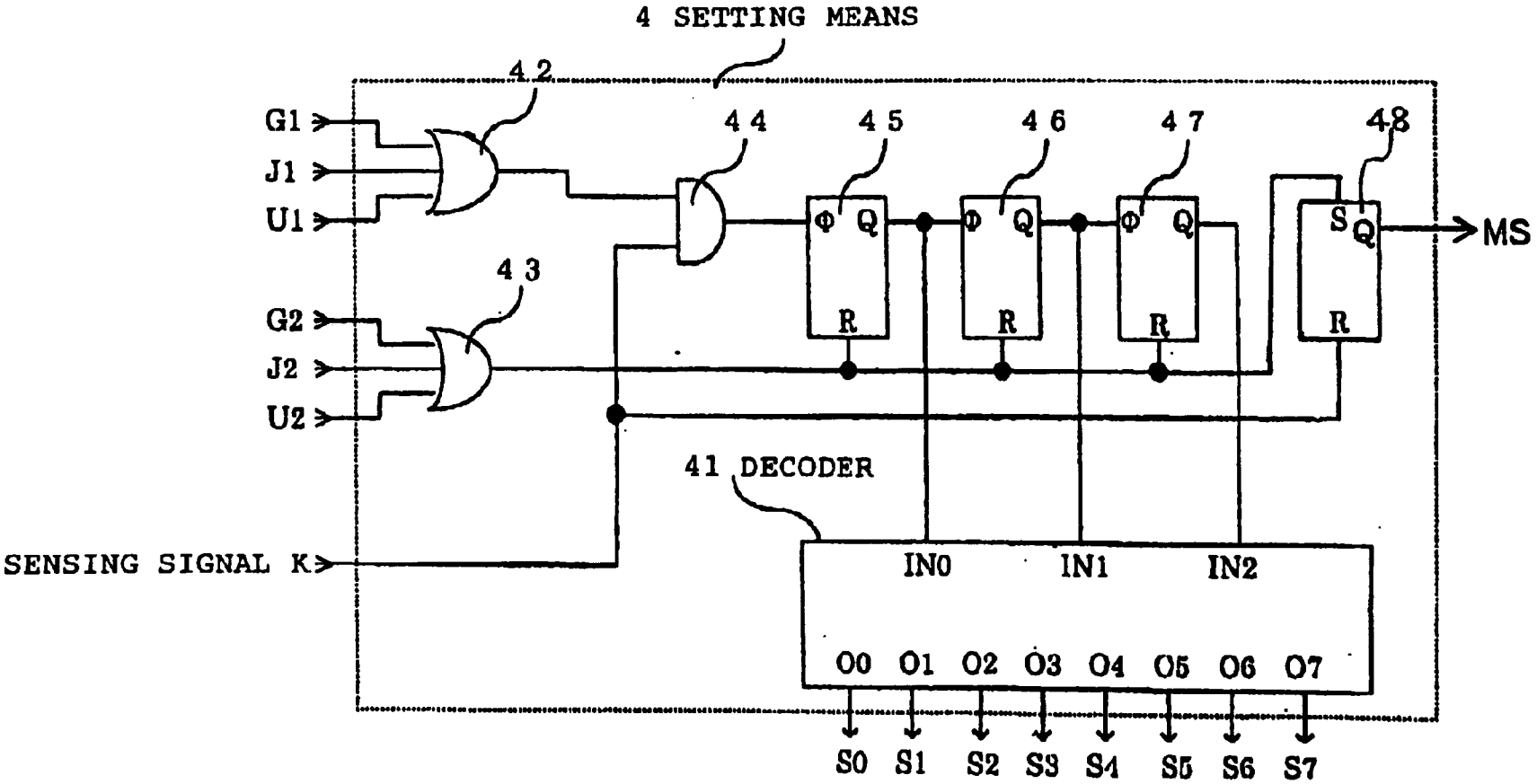
FIG. 2 is a detailed diagram of setting means constituting one circuit component of the present invention.
Figure 3:
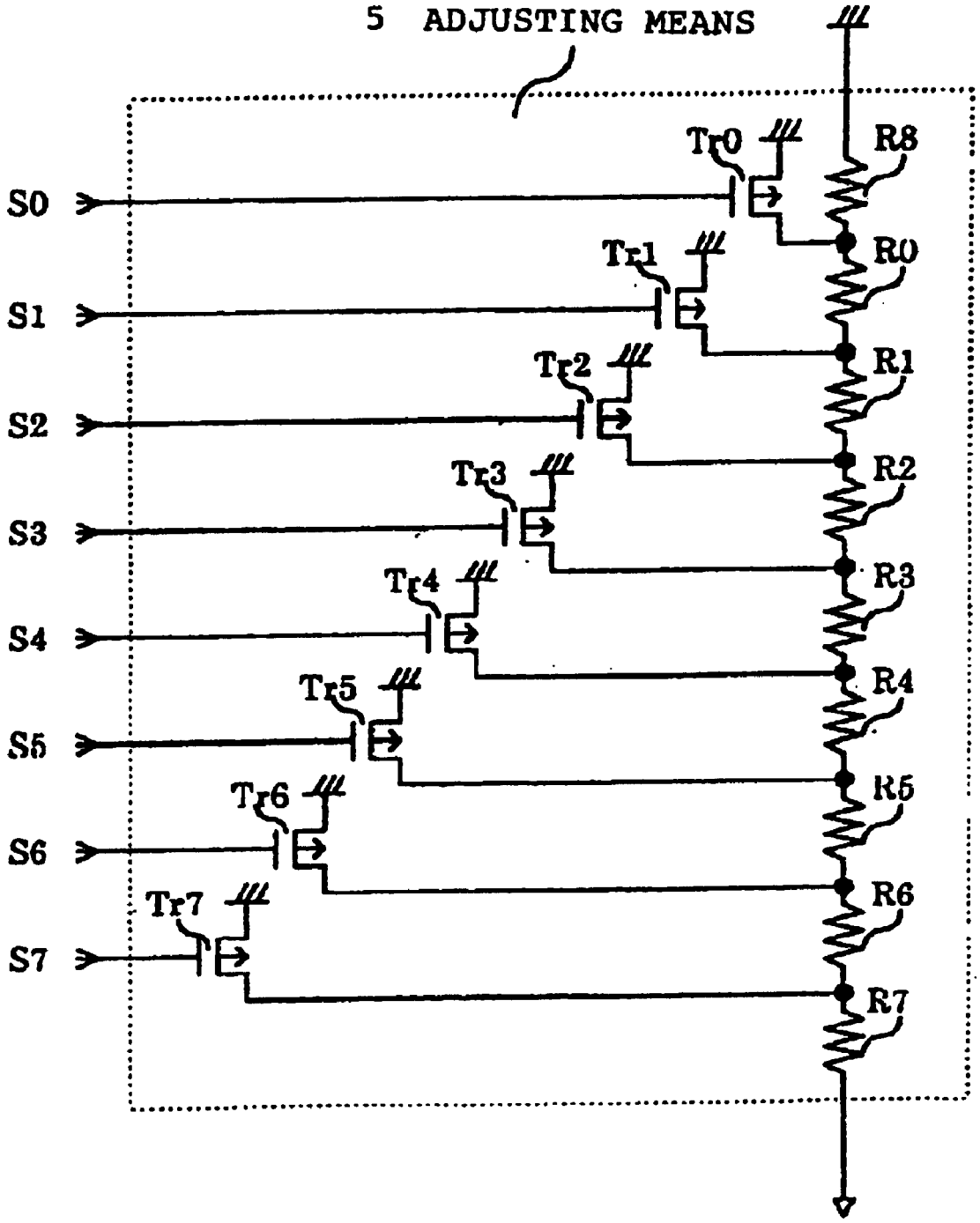
FIG. 3 is a detailed diagram of adjusting means constituting one circuit component of the present invention.
Figure 4:
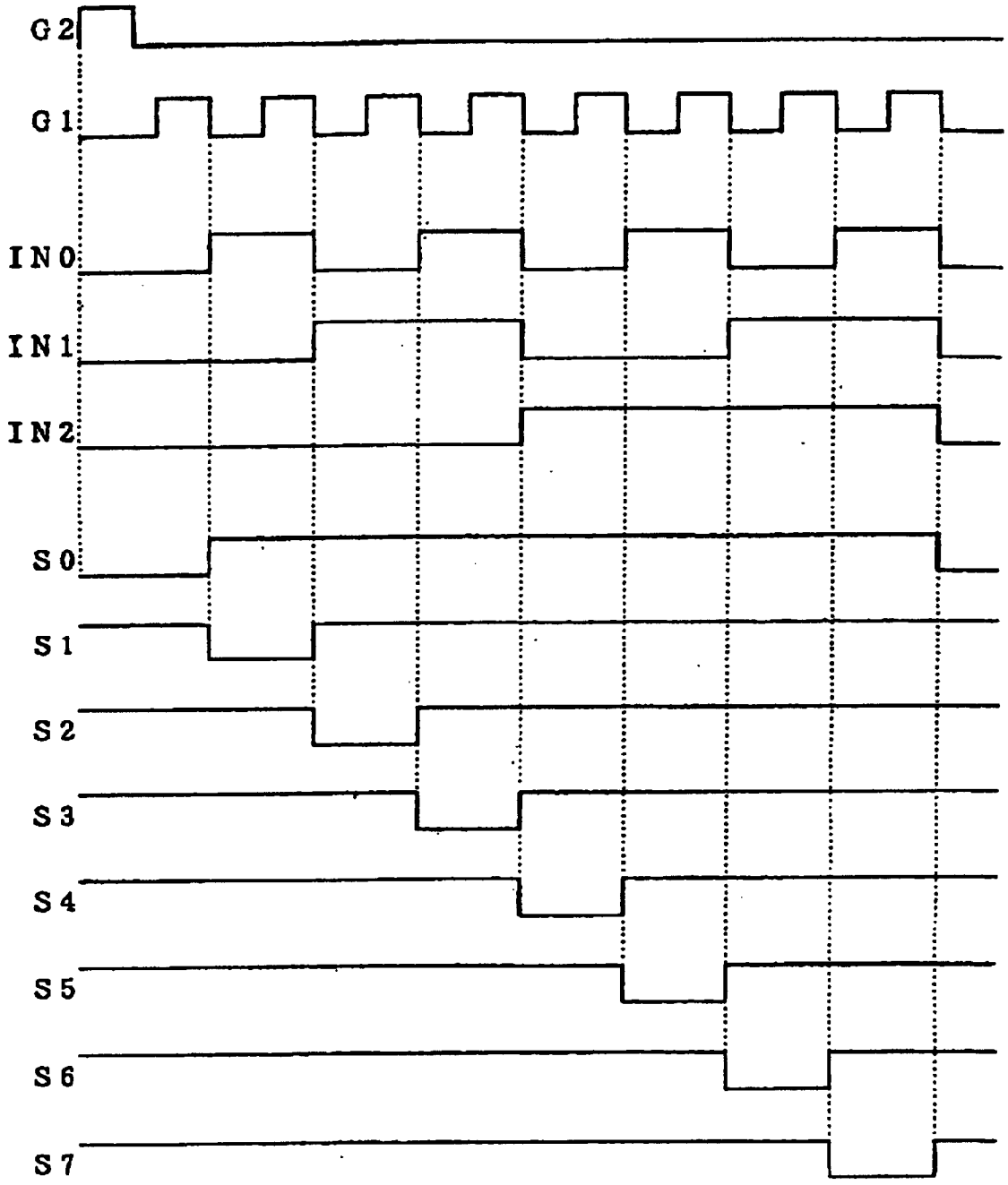
FIG. 4 is an operation timing chart for the setting means of the present invention.

Embodiments of an electronic timepiece relating to the present invention will be described hereinafter. FIG. 1 is a circuit block diagram of an embodiment of the present invention, FIG. 2 is a detailed diagram of setting means constituting one circuit component of the present invention, FIG. 3 is a detailed diagram of adjusting means constituting one circuit component of the present invention, and FIG. 4 is an operation timing chart for the setting means.

In FIG. 1 are shown external switch means 1 settable in a circuit board state or a module state and for entering the setting mode by controlling a terminal pattern on the circuit board by an external switch (not shown), and external magnetic field means 2 settable in a completed timepiece state and for entering the setting mode with contract-free by placing a test mode signal on an external magnetic field signal. Also shown are software controlling means 3. Namely, the completed timepiece has a push button and a predetermined operation of this push button enables one mode of userselectable added functions to be entered. Adding the entry into the setting mode to one selectable added function, the setting mode can be entered through software by a pushbutton operation. Setting means 4 output setting signals S on the basis of outputs G1 and G2 of the above-mentioned external switch means 1, or outputs J1 and J2 of the external magnetic field means 2, or outputs U1 and U2 of the software controlling means 3.

Adjusting means 5 receive setting signals S and vary an internal resistance value and sensing means 6 output a sensing signal K of an L level when the output (point A) of the adjusting means 5 is greater than or equal to a threshold level (H). The adjusting means 5 and the sensing means 6 constitute power-save mode switching means. The sensing means 6 can be, for example, an inverter.

Informing means 7 perform a informing operation for a predetermined period when the above-mentioned sensing signal K is an L level and use the above-mentioned sensing signal K as an input signal, and storage means 10, such as secondary cells, store electric power that is output from power generating means 11 to be described hereinafter and power the various circuits. The power generating means 11 comprise solar cells and generate electric power, reverse current blocking means 12 prevent the electric power of the storage means from leaking via the power generating means 11 when the amount of generated energy of the power generating means 11 is small, an oscillation circuit 14 outputs a reference signal, a frequency dividing circuit 15 divides the reference signal and outputs signals of various frequencies, and a circuit for controlling drive of hands 18 controls the movement of each hand to be described hereinafter.

An hour and minute display section 20 for displaying hours and minutes has an hour hand 20*a* and a minute hand 20*b*, and a second display section 21 has a second hand 21*a*.

Also shown are an OR gate 31 and an AND gate 32.

The action of the relating configuration will be described. Operating the external switch means 1, the external magnetic field means 2, or the software controlling means 3, cause the output signals G1, G2, and so forth, to be received and the setting means 4 to output setting signals S. Details will be described hereinafter using FIG. 2.

The internal resistance value of the adjusting means 5 is varied by the setting signals S. Details will be described hereinafter using FIG. 3.

When the internal resistance value of the adjusting means 5 is varied, the potential (voltage value) at point A of the input value of the sensing means 6 is the product of the amount of generated energy (current) of the power generating means 11 and the above-mentioned internal resistance value so that the potential at point A changes. The sensing means 6 output the sensing signal K of an L level when the potential at point A is greater than or equal to a threshold value (H). With the output of this L level sensing signal K, the mode is switched to a power-save mode, for example, in which the drive of the second hand is halted or the like, by a control system of the overall electronic timepiece (not shown).

Namely, the mode switches to the power-save mode in accordance with the product of the amount of generated energy (current) of the power generating means 11 and the above-mentioned internal resistance value. The setting of the predetermined value of the amount of generated energy for switching to the power-save mode and the power-save mode operation will be described in detail hereinafter.

FIG. 2 is detailed block diagram of the setting means 4 comprising an OR gate 42, an OR gate 43, an AND gate 44, flip-flops 45, 46, and 47 serially connected in 3 stages, and a decoder 41. The OR gate 42 and the OR gate 43 respectively input increment signals G1, J1, and U1 and initialize signals G2, J2, and U2 from the external switch means 1, the external magnetic field means 2, and the software controlling means 3. The output of the OR gate 42 is input by the Φ input of the flip-flop 45 via the AND gate 44. The output of the OR gate 43 is input by the reset terminals (hereinafter referred to as the R terminals) of the flip-flops 45 to 47. The other terminal of the AND gate 44 inputs the sensing signal K from the sensing means 6. The decoder 41 is connected with the Q output of the flip-flop 45 to the input terminal INO, the Q output of the flip-flop 46 to IN1, and the Q output of the flip-flop 47 to IN2.

Also, a flip-flop 48 for outputting a setting mode signal MS is set by the initialize signal and outputs the setting mode signal MS, and is reset by the sensing signal K to be described hereinafter.

The operation of the setting means 4 will be described next using the timing chart of FIG. 4. For convenience, the description will be given for the case using the external switch means 1. However, the operation is similar for the case using the external magnetic field means 2 or the software controlling means 3.

When the initialize signal G2 is input, the flip-flops 45 to 47 are reset, the combination at the input terminals (IN0, IN1, IN2) of the decoder 41 becomes "0, 0, 0" and a setting signal SO of an L level is selectively output from 00.

Next, when one pulse of the increment signal G1 is input by Φ of the flip-flop 45, the combination of the input terminals (IN0, IN1, IN2) of the decoder 41 becomes "1, 0, 0" and a selection signal Si of an L level is output from O1.

Furthermore, when another pulse of the increment signal G1 (total of two pulses) is input, the combination of the input terminals (IN0, INl, IN2) of the decoder 41 becomes "0, 1, 0" and a selection signal S2 of an L level is output from O2.

In a similar manner, a total of up to 8 pulses of the increment signal G1 is possible where the combination of the input terminals (IN0, IN1, IN2) becomes "1, 1, 1" so that one terminal up to O7 outputs an L level for selection signals S0 to S7 as setting signals S.

The flip-flop 48 is set after receiving the initialize signal and outputs the setting mode signal MS.

The case where setting signals S of 8 bits were described but the present invention is not limited to this.

In this manner, by operating the external switch means 1, the external magnetic field means 2, or the software controlling means 3, the setting means 4 receive the output signals G1, G2, and so forth, and output the setting signals S.

FIG. 3 is a detailed block diagram of the adjusting means 5 comprising switch means Tr0 to Tr7 and resistors R0 to R8. Although the resistors R0 to R8 will be described as all having a common resistance value of 0.5 MΩ, the switch means, number of resistors, and resistance values of the resistors are not limited to the description herein.

The selection signal S0 is connected to the gate of the switch means Tr0, the selection signal S1 is connected to the switch means Tr1, and so forth, and the selection signal S7 is connected to the switch means Tr7. Respective switch means Tr turn on when the gate inputs an L level signal, and turn off when the gate inputs an H level signal.

If all the switch means Tr input the H level signal, the resistance value becomes 0.5 MΩ×9=4.5 MΩ). If the gate of the switch means Tr0 inputs the L level signal, the resistance value becomes 0.5 MΩ×8=4.0 MΩ. If the gate of the switch means Tr1 inputs the L level signal, the resistance value becomes 0.5 MΩ×7=3.5 MΩ. In a similar manner, the resistance value decreases by 0.5 MΩ, and if the gate of the switch means Tr7 inputs the L level signal, the resistance value becomes 0.5 MΩ×1=0.5 MΩ.

The operation of the adjusting means 5 will be described next. When the adjusting means 5 input the setting signal S0 of the L level, the largest resistance R0+R1+R2+R3+R4+R5+R6+R7 (=4.0 MΩ) is selected.

Next, when the setting signal S1 of the L level is input, the resistance R1+R2+R3+R4+R5+R6+R7 (=3.5 MΩ) is selected.

Furthermore, when the setting signal S2 of the L level is input, the resistance R2+R3+R4+R5+R6+R7 (=3.0 MΩ) is selected.

In a similar manner, when the when the setting signal S7 of the L level is input, the resistance R7 (=0.5 MΩ) is selected.

Thus, the internal resistance value of the adjusting means 5 can be varied by the setting signals S.

The relationship between the adjusting means 5 and the sensing means 6 will next be described in detail.

As clearly shown in FIG. 1, point A is the input for sensing means 6 and is where the power generating means 11 and the adjusting means 5 connect. The potential at point A is determined by the amount of generated energy (generated current) of the power generating means 11 and the resistance value of the adjusting means 5, and the potential difference with VDD (ground level) increases as the generated current of the power generating means 11 increases. The sensing means 6 in this embodiment are set so that the output level switches with the potential at point A at −0.4 V (threshold value). Namely, when the potential at point A, determined from the resistance value adjusted by the adjusting means 5 and the amount of generated energy (generated current) of the power generating means 11, is greater than or equal to the threshold value of −0.4 V (difference with VDD is 0.4 V or less, H), the sensing means 6 output the sensing signal K of an L level and the entire timepiece is switched to the power-save mode. In this manner, the power-save mode switching means comprise the adjusting means 5 and the sensing means 6.

Thus, so as to switch to the power-save mode at a predetermined generated energy or lower, the resistance value of the adjusting means 5 is adjusted so that the potential at point A becomes −0.4 V or higher at the generated energy at which the power-save mode is to be entered. In other words, by adjusting the resistance value of the adjusting means 5, a predetermined value of the generated energy when switching to the power-save mode can be adjusted.

In this manner, when the level of the energy generated by the power generating means 11 is at the predetermined value or lower, the power-save mode switching means for switching to the power-save mode can have the predetermined value of the generated energy, at which the power-save mode is to be entered, adjusted by the adjusting means 5.

The sensing means 6 are continuously operating due to the setting mode signal MS in the setting mode, and in an ordinary state, are intermittently operating due to a signal from the frequency dividing means 15. This reduces the power consumption of the sensing means 6 in the ordinary state.

The setting operation for setting the predetermined value of the generated energy at which the power-save mode is to be entered will be described next.

Figure 5:
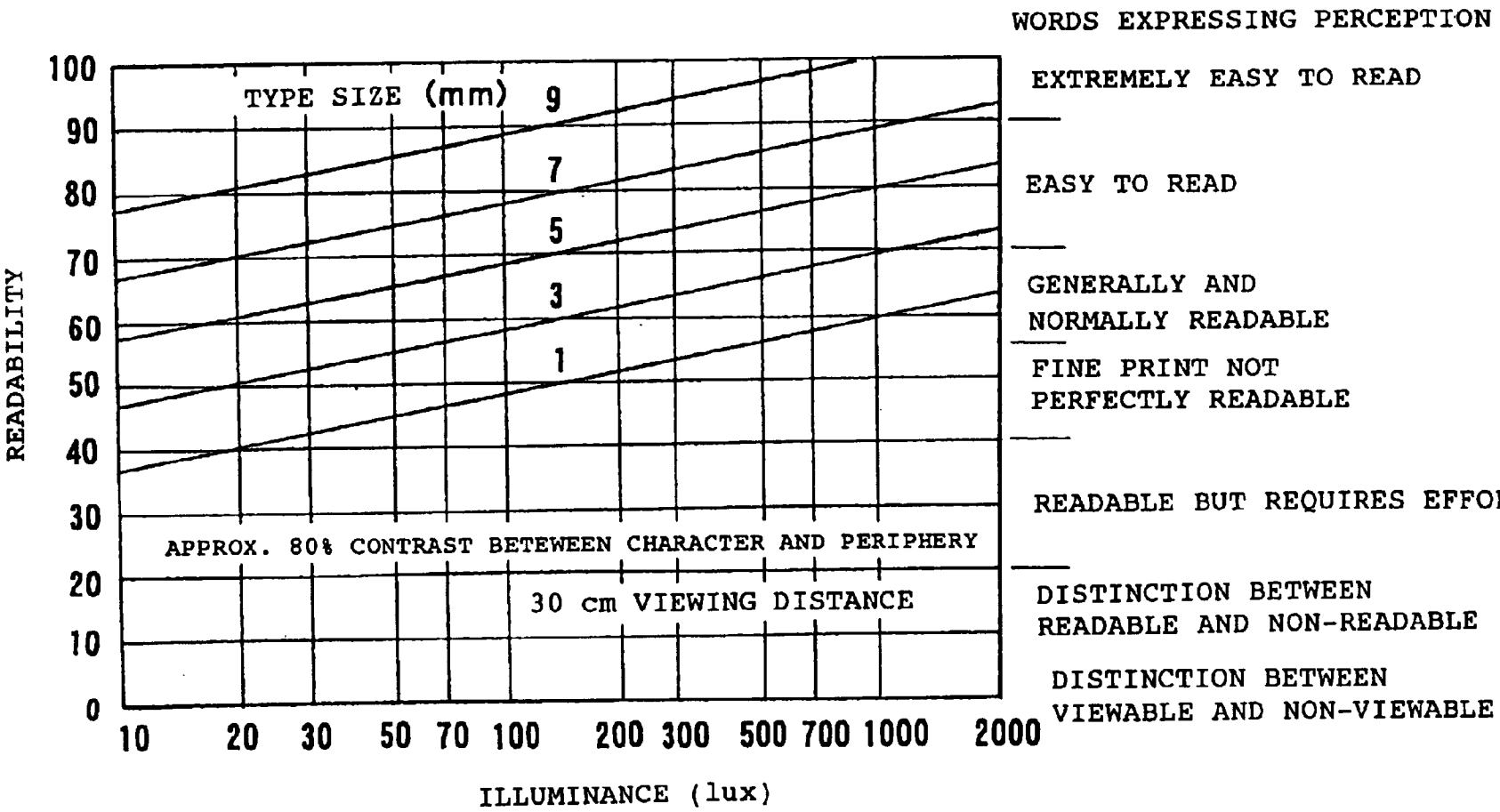
FIG. 5 shows the illumination standard included in JIS document number JIS Z9110: 1979.
Figure 6:
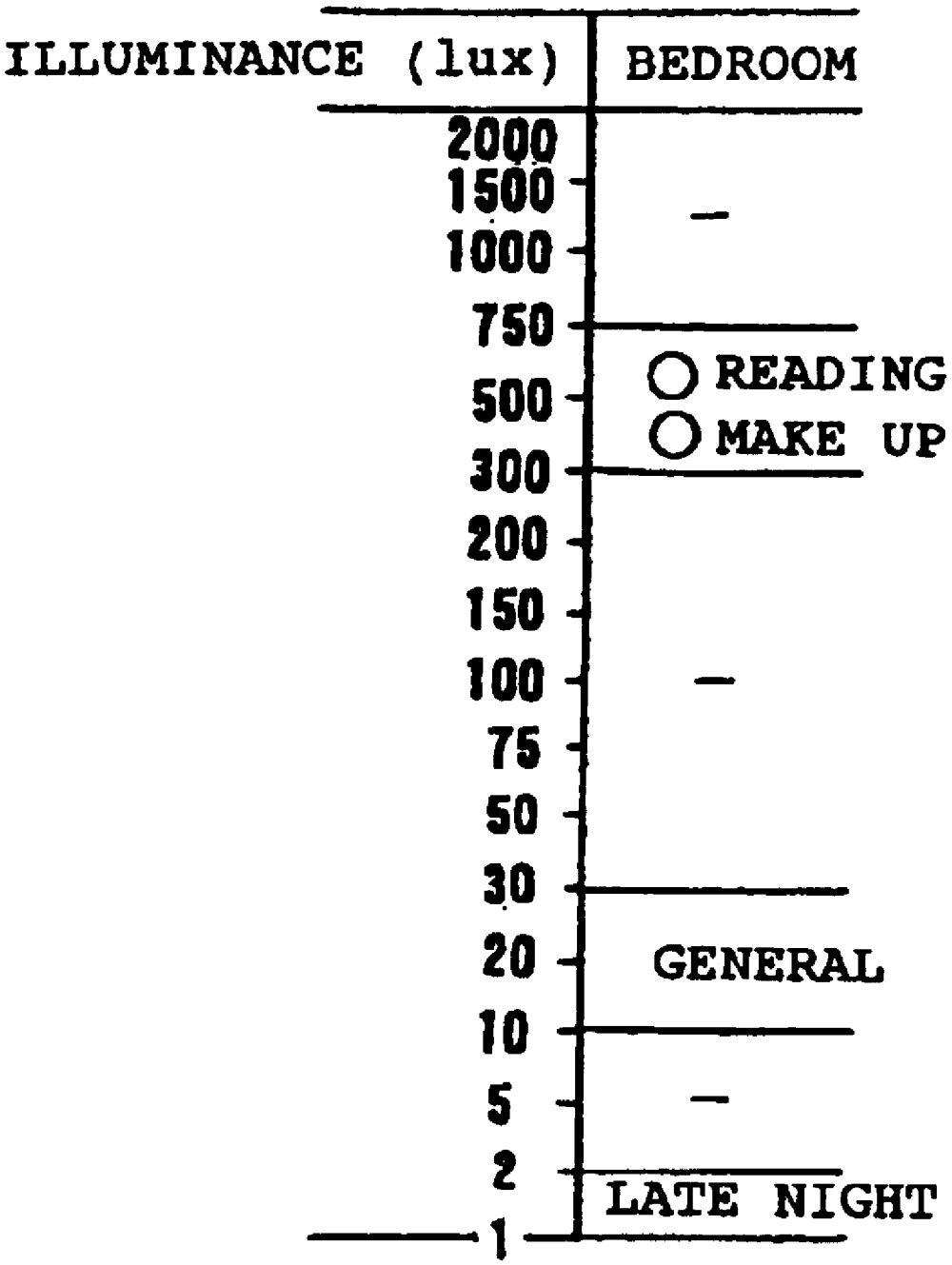
FIG. 6 shows an excerpt of a residential illumination standard by JIS.

Prior to performing the setting operation, the environment (illumination) is adjusted to the set illuminance (illuminance at which the timepiece transfers to the power-save mode). The illumination at which the power-save mode is entered will be described with reference to FIGS. 5 and 6. FIG. 5 represents an illumination standard included in JIS (Japanese Industrial Standards) document number JIS Z9110:1979. According to this document, when the character size is 1 mm, the readability under an illuminance of 20 lux is to a degree of "readable but requires effort." Further, FIG. 6 shows an excerpt of a JIS residential illumination standard (source: Electrical Encyclopedia, page 663, 1982, Ohmsha). According to this document, the lower limit of general lighting for bedrooms is 10 lux. Therefore, a rough guide to the limit of illumination at which the electronic timepiece can be viewed, or the time can be read is 10 lux. Furthermore, when positively taking power saving into consideration, the illuminance at which the electronic timepiece cannot be viewed or the electronic timepiece can be viewed but the time cannot be read can be assumed to be, for example, half of 10 lux, or 5 lux. In the description of the embodiment hereinafter, the set illuminance is assumed to be 5 lux.

For convenience in the following description, the potential at the input (point A), where the sensing signal K of the sensing means 6 is switched from the H level (non-power-save mode) to the L level (power-save mode), is assumed to be −0.4 V (namely, the power-save mode when the potential difference with VDD is 0.4 V or more), and the generated current is assumed to be 0.4 $\mu$A when an ambient light of 5 lux directly strikes the solar cells. However, the present invention is not limited to these conditions.

The case where the transmittance of the dial is high (for example, 100% in this embodiment) will be described first.

When the external switch means 1 are operated, the initialize signal G2 is output. As a result, the flip-flop 48 is set, the setting mode signal MS is output to enter the setting mode. When the external switch means 1 are operated successively, one pulse of the increment signal G1 is output. When the external switch means 1 are further operated, another single pulse of the increment signal G1 is output. When this is repeated in this embodiment to a point where six pulses of the increment signal G1 are output (adjusting means 5 select resistance R6+R7 (=1.0 MΩ) and the output of the power generating means 11 is pulled up by the 1.0 MΩ resistance), the potential at point A rises to −0.4 V (H level), and the sensing signal K of the L level is output from the sensing means 6.

When the sensing signal K of the L level is output, the informing means 7 emit a sound of a predetermined duration. As a result, an operator can be informed that the resistance adjustment of the adjusting means 5 has completed. Furthermore, since one input of the AND gate 44 of the setting means 4 becomes an L level, any subsequent increment signal G1 is canceled and the flip-flop 48 is simultaneously reset. As a result, the setting mode terminates.

The case where the transmittance of the dial is low (for example, 50% in this embodiment) will be described next.

With a transmittance of 50% when the ambient light is 5 lux, a light of half of 5 lux or 2.5 lux strikes the power generating means 11 so that the generated current is 0.2 $\mu$A.

When the external switch means 1 are operated and the setting mode is entered, the initialize signal G2 is output. When the external switch means 1 are operated successively, one pulse of the increment signal G1 is output. When the external switch means 1 are further operated, another single pulse of the increment signal G1 is output. When this is repeated in this embodiment to a point where four pulses of the increment signal G1 are output (adjusting means 5 select resistance R4+R5+R6+R7 (=2.0 MΩ) and the output of the power generating means 11 is pulled up by the 2.0 MΩ resistance), the potential at point A becomes −0.4 V, and the sensing signal K of the L level is output from the sensing means 6. When the sensing signal of the L level is output, the setting mode terminates as described above.

After assembly of the entire electronic timepiece at the factory and before the first setting operation is performed, the state of the switches Tr1 to Tr7, for selecting the resistors R0 to R7 of the adjusting means 5, selects the maximum resistance value. This basically enables the power-save mode to be set before the first setting operation is performed.

Furthermore, writing the above-mentioned setting to a memory device (not shown), such as nonvolatile memory is effective since the setting is retained even though various circuits are initialized due, for example, to a voltage drop in the storage means 10.

In this embodiment as described in the foregoing, the sensing signal K switches from the H to the L level when the illuminance of the ambient light is 5 lux or lower even though the transmittance of the dial changes.

Figure 7:
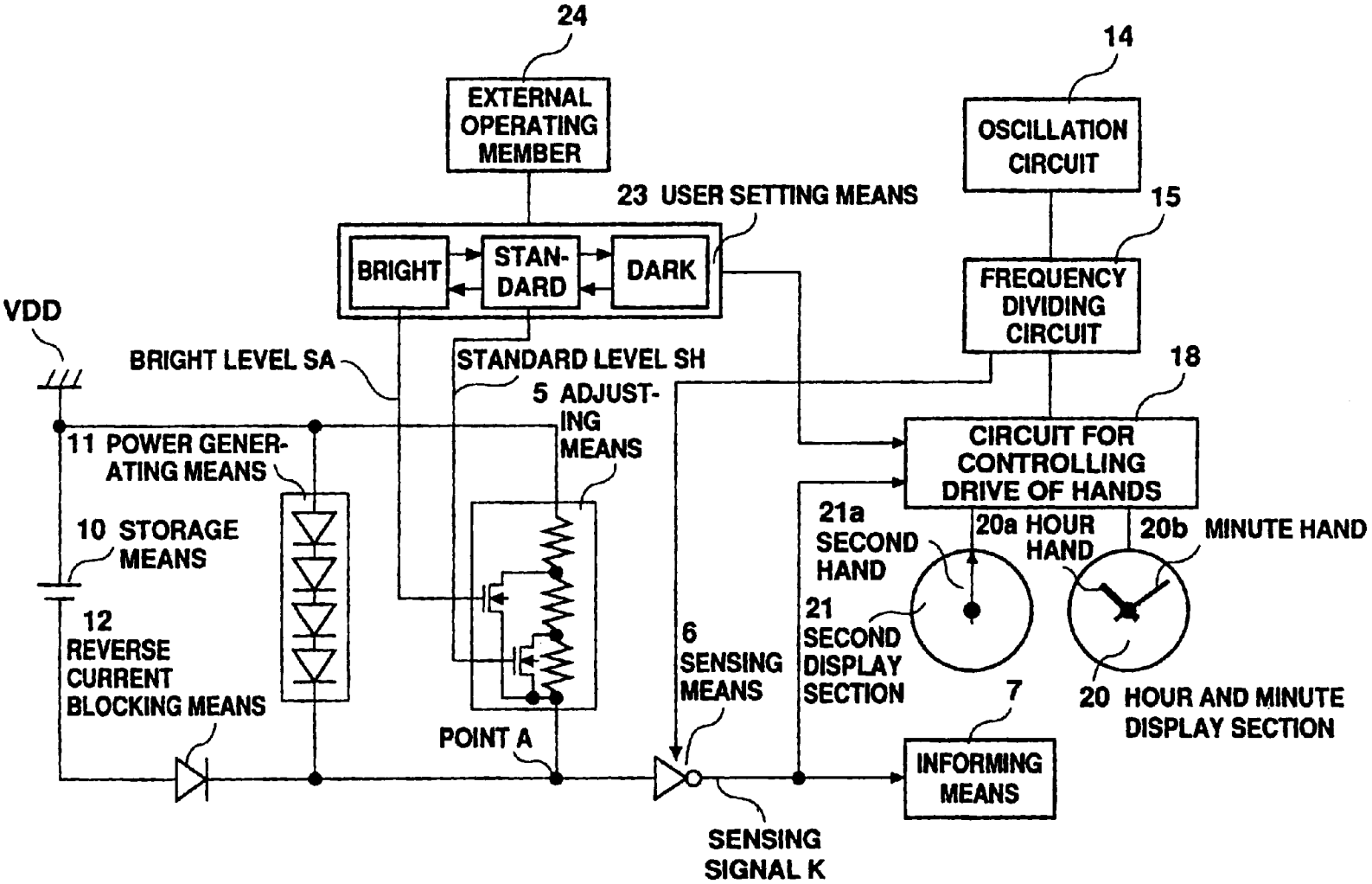
FIG. 7 shows a configuration of another embodiment of the present invention in which user setting means are provided and adjusting means are controlled by user input.

Furthermore, in the above-mentioned embodiment, the environment (illumination) is adjusted to the set illuminance of ambient light of 5 lux, for example. Therefore, without regard to user perception, all electronic timepieces of the same model enter the power-save mode when the ambient light is, for example, 5 lux or less. FIG. 7 shows a configuration providing user setting means 23 and capable of controlling the adjusting means 5 by user input. For example, in FIG. 7, one of three levels of "standard", "dark", and "bright" can be selected by user input. For example, compared to "standard", the resistance value is one step larger when "dark" is selected, and one step smaller when "bright" is selected. This enables switching to the power-save mode at an illuminance matching the perception of the individual user.

However, generally speaking, it is preferable to set the power (current) that is generated by the power generating means 11 under the set illuminance to a value that is larger than the current value for driving the second hand of the electronic timepiece, for example, and adjust the predetermined value of the generated energy at which the power-save mode is entered.

In the above-mentioned embodiment, unifying the illuminance at which the power save is entered was described as one object of the present invention. Preventing the timepiece from stopping before entering the power-save mode is another object of the present invention that is achieved by the configuration of the above-mentioned embodiment. For example, for a dial having a low transmittance the generated energy is a small current value for driving the electronic timepiece of a level comparable to current value for driving the second hand. The predetermined value that is adjusted by the adjusting means is greater than or equal to a predetermined generated energy capable of driving the timepiece. Prior to entering the power-save mode, for example, this prevents the second hand from stopping. For example, with the current value for driving the second hand is set to 0.3 μA, the above-mentioned predetermined value is set so as to be adjustable at 0.3 μA or higher, in the above-mentioned example of 5 lux and generated energy of 0.4 μA, the mode is switched to the power-save mode at 3.75 lux or lower at the power generating means 11. Therefore, for a dial having a transmittance of 50%, the mode is switched to the power-save mode when the ambient light is 7.5 lux or lower to match the current for driving the second hand.

Figure 8:
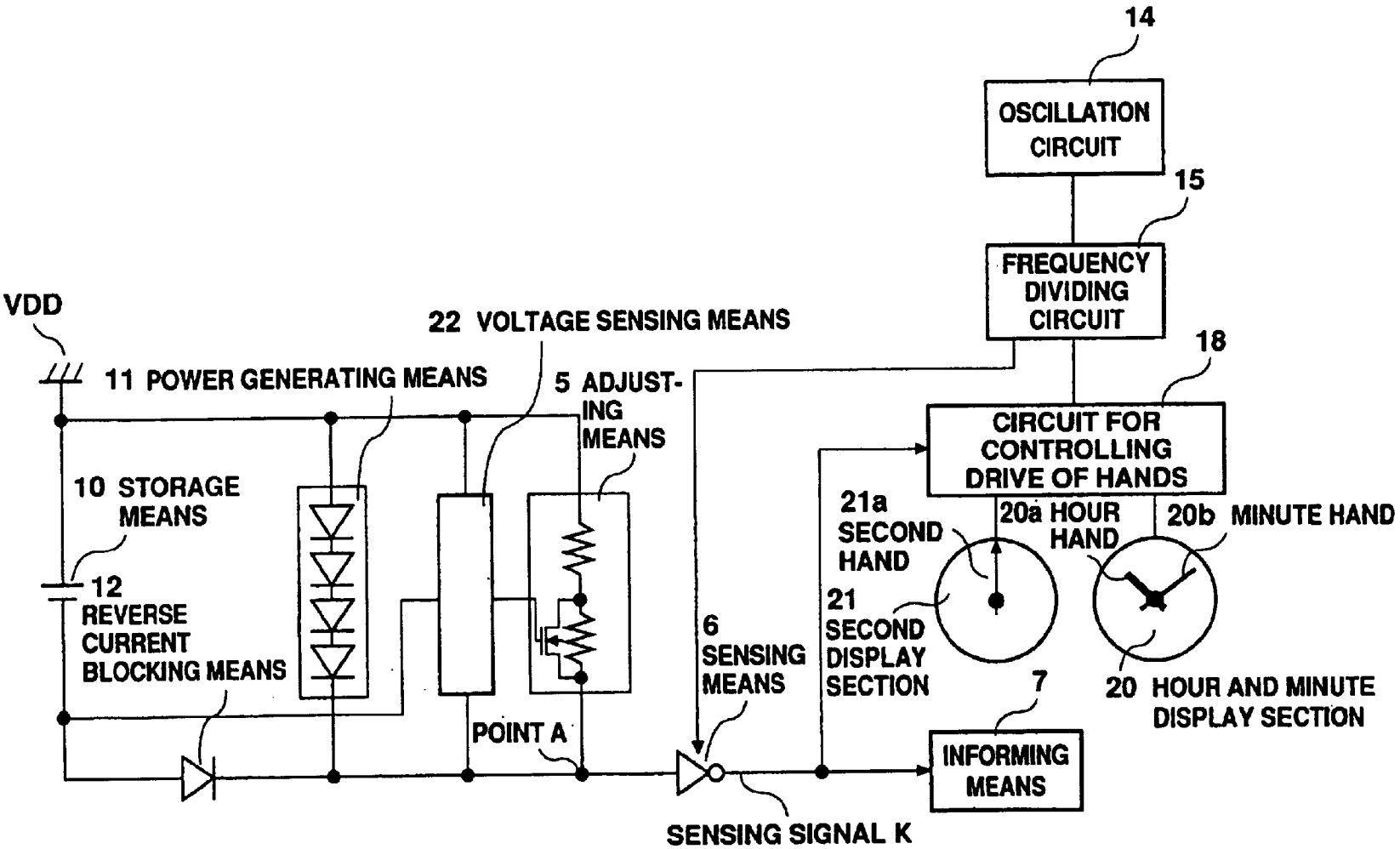
FIG. 8 shows a configuration of another embodiment of the present invention in which the control of the adjusting means is performed with an output of voltage sensing means for sensing the amount of storage of storage means.

Furthermore, in the above-mentioned embodiment, the setting operation was described as being unrelated to the amount of storage of the storage means 10 provided in the electronic timepiece. FIG. 8 shows a configuration where the control of the adjusting means 5 is performed by an output of voltage sensing means 22 for sensing the amount of storage of the storage means 10. For example, when the amount of storage of the storage means 10 is low and the output of the voltage sensing means 22 is high (near VDD), the resistance value of the adjusting means 5 is set to a smaller value so that the predetermined value of the generated energy at which the mode is switched to the power-save mode is set to a larger value. This enables the necessary storage to be performed quickly by switching to the power-save mode at a higher level of illumination when sufficient storage has not been performed.

The setting operation will next be described briefly for the case using the external magnetic field means 2 and the software controlling means 3 instead of the external switch means 1.

The external magnetic field means 2 are means for entering the setting mode with contract-free. The motor coil of an analog timepiece is used for the communication (mode control) of commands at a timing besides that for hand movements. A mode setting technique using an external magnetic field is widely known. This technique is disclosed in Japanese Patent Laid-Open Publication No. Hei 11-84028, filed by the present applicant. In the present embodiment, two types of signals, increment signal J1 and initialize signal J2, are provided. Since they are settable in the completed timepiece state, they are particularly effective in solar timepieces with increased variations of various (colors) dials with a common module.

The software controlling means 3 enter the setting mode by an operation of an external operating member, such as a push button, in the state of the completed timepiece. In the actual operation, if the setting mode is set at a desired brightness (to transfer to the power-save mode), the initialize signal U2 is first output and the increment signal U1 is automatically output until the output K of the sensing means 6 switches to the L level. This method is settable in the completed timepiece state and is particularly effective in solar timepieces with increased variations with various (colors) dials with a common module. Furthermore, since setting by the user is possible, the illuminance can be set according to user preference.

The operation of the power-save mode of the electronic timepiece after the above mentioned setting is completed will be described.

The electronic timepiece of the present embodiment has a two-motor specification in which the hour and minute display section 20 and the second display section 21 are separate. When the sensing means 6 sense non-power generation, the hour hand 20*a* and the minute hand 20*b* of the hour and minute display section 20 continue to clock the time, and the power-save mode is entered by stopping only the second hand 21*a* of the second display section 21.

When the transmittance of the dial is 100% at an illuminance state of 10 lux, the generated current of the power generating means 1 is large so that the current flowing to the pull-up resistance (R6+R7=1.0 MΩ) of the adjusting means 5 is larger than 0.4 μA and the potential at point A becomes a lower (L) level than −0.4 V. Thus, the sensing signal K of an H level is output. When the sensing signal K is an H level, power is being generated so that the hour and minute display section 20 and the second display section 21 continue to clock the time.

When the transmittance of the dial is 50% at an illuminance of 10 lux, the generated current of the power generating means 11 decreases and the current flowing to the pull-up resistance of the adjusting means 5 becomes 0.4 μA. The pull-up resistance of the adjusting means 5 (R4+RS+R6+R7=2.0 MΩ) is large so that the potential at point A decreases below −0.4 V. Thus, in the same manner, the hour and minute display section 20 and the second display section 21 continue to clock the time.

When the transmittance of the dial is 100% and the illuminance drops to 5 lux or lower, the generated current of the power generating means 11 decreases and the current flowing to the pull-up resistance (1.0 MΩ) of the adjusting means 5 is 0.4 μA. Thus, since the potential at point A becomes −0.4 V, the sensing signal K of the L level is output. When the sensing signal K becomes the L level, the circuit for controlling the drive of hands 18 does not output a driving signal to the second display section 21. Thus, although the hour and minute display section 20 continues to clock the time, the power-save mode is entered and the second display section 21 stops.

When the transmittance of the dial is 50% and the illuminance is 5 lux or lower, the generated current of the power generating means 11 decreases and the sensing signal K of the L level is output. As a result, the second display section 21 stops.

During normal operation, the informing means 7 do not operate even though the sensing signal K of the L level is output since the setting mode signal MS is an L level.

In the above-mentioned configuration, the output of the power generation sensing means 6 switches from an H level to an L level at a set illuminance (5 lux in the present embodiment) or lower regardless of the transmittance (color) of the dial. Thus, the illuminance at which the power-save mode is entered does not vary due to the transmittance (color) of the dial.

In the above-mentioned embodiment, a configuration having three means of external switch means 1, external magnetic field means 2, and software controlling means 3 was described. However, the present invention is not limited to this configuration and the present invention can be embodied with any one means.

Furthermore, the mode assumed only the second hand was stopped during power save. However, the hour and minute hands may be stopped, or an operation besides that for hands (such as added functions) may be stopped.

Furthermore, the mode was described in which the generated energy at which the power-save mode is entered is determined on the basis of the current value for driving the second hand. However, the present invention is not limited to this. For example, the consumption current value per time unit for the minute hand, hour hand, liquid crystal display device, or other added functions may also be referenced to determine the generated energy at which the power-save mode is to be entered.

Although solar cells were used for the power generating means in the description, the present invention is also applicable in other power generation methods, such as thermoelectric power generation, self-winding power generation, and so forth. For example, in the case of thermoelectric power generation, an embodiment of the present invention enables the power-save mode to be entered at the same temperature difference even though a difference develops in the generated energy due to the thickness of the back cover or the like, depending on the model of the electronic timepiece.

As described in the above, in the electronic timepiece having the power generation sensing function, the adjusting means for adjusting the power generation level and the setting means for controlling the adjusting means are provided so that the present invention can provide an electronic timepiece that enters power save at the set illuminance.

Industrial Applicability

The present invention is usable in electronic timepieces.

What is claimed is:

1. An electronic timepiece comprising power save means for switching to a power-save mode in which power consumption is reduced when a predetermined condition is satisfied, the electronic timepiece comprising:

power generating means;

storage means for storing energy generated by the power generating means;

power-save mode switching means switching to the power-save mode when the level of energy generated by the power generating means is less than or equal to a predetermined value; and adjusting means for setting the predetermined value under different ambient power generating conditions experienced by the electronic timepiece.

2. An electronic timepiece according to claim 1, wherein the predetermined value is greater than or equal to a predetermined amount of generated energy that can drive the timepiece.

3. An electronic timepiece according to claim 1, wherein the predetermined value is greater or equal to a predetermined amount of generated energy that can drive a second hand.

4. An electronic timepiece according to claim 1, wherein the adjusting means comprises resistors and switches for selecting the resistors.

5. An electronic timepiece according to claim 1, wherein setting means is provided for controlling the adjusting means and a setting mode is included for allowing operation of the setting means.

6. An electronic timepiece according to claim 5, wherein a state of the switches for selecting the resistors of the adjusting means, until the setting mode is first allowed, selects a maximum resistance value.

7. An electronic timepiece according to claim 5, wherein the setting means is user setting means for controlling the adjusting means by user input.

8. An electronic timepiece according to claim 5, wherein the setting mode controls the adjusting means in a state in which predetermined illuminance of light is supplied to the timepiece.

9. An electronic timepiece according to claim 8, wherein the predetermined illuminance is less than or equal to 10 lux.

10. An electronic timepiece according to claim 8, wherein the predetermined illuminance is less than or equal to 5 lux.

11. An electronic timepiece according to claim 5, wherein the setting mode completes operation by a change in output of the power-save mode switching means.

12. An electronic timepiece according to claim 5 further comprising informing means for operating at completion of operation of the setting mode.

13. An electronic timepiece according to claim 5, wherein the setting mode can be entered by an external switch operation.

14. An electronic timepiece according to claim 5, wherein the setting mode can be entered by a contact-free external magnetic field control.

15. An electronic timepiece according to claim 5, wherein the setting mode can be entered through one mode of user-selectable functions.

* * * * *

UNITED STATES PATENT AND TRADEMARK OFFICE

CERTIFICATE OF CORRECTION

PATENT NO. : 6,819,634 B2
DATED : November 16, 2004
INVENTOR(S) : Kiyotaka Igarashi It is certified that error appears in the above-identified patent and that said Letters Patent is hereby corrected as shown below:

Title page,
Item [54], Title, change "ELECTRONIC CLOCK" to -- ELECTRONIC TIMEPIECE --.

Signed and Sealed this

Thirteenth Day of June, 2006

JON W. DUDAS
*Director of the United States Patent and Trademark Office*